US007556865B2

(12) United States Patent
Drillet et al.

(10) Patent No.: US 7,556,865 B2
(45) Date of Patent: Jul. 7, 2009

(54) HOT-DIP COATING METHOD IN A ZINC BATH FOR STRIPS OF IRON/CARBON/MANGANESE STEEL

(75) Inventors: Pascal Drillet, Rozerieulles (FR); Daniel Bouleau, Metz (FR)

(73) Assignee: Arcelor France, Saint Denis (FR)

( * ) Notice: Subject to any disclaimer, the term of this patent is extended or adjusted under 35 U.S.C. 154(b) by 0 days.

(21) Appl. No.: 11/577,536

(22) PCT Filed: Oct. 10, 2005

(86) PCT No.: PCT/FR2005/002491

§ 371 (c)(1),
(2), (4) Date: Oct. 5, 2007

(87) PCT Pub. No.: WO2006/042930

PCT Pub. Date: Apr. 27, 2006

(65) Prior Publication Data

US 2008/0083477 A1 Apr. 10, 2008

(30) Foreign Application Priority Data

Oct. 20, 2004 (FR) ..... 04 11190

(51) Int. Cl.

| | |
|---|---|
| ***B32B 15/18*** | (2006.01) |
| ***C21D 1/74*** | (2006.01) |
| ***C23C 2/06*** | (2006.01) |
| ***C23C 2/40*** | (2006.01) |

(52) U.S. Cl. ..... 428/659; 148/533; 428/939; 427/433

(58) Field of Classification Search ..... 427/430.1, 427/433, 435, 436, 437, 443.1, 443.2; 148/579
See application file for complete search history.

(56) References Cited

U.S. PATENT DOCUMENTS

| | | | | |
|---|---|---|---|---|
| 4,512,804 | A | 4/1985 | Kos | |
| 6,572,713 | B2 * | 6/2003 | Kucharczyk et al. | 148/329 |
| 7,294,412 | B2 * | 11/2007 | Takada et al. | 428/659 |
| 2008/0053580 | A1 * | 3/2008 | Drillet et al. | 148/620 |

FOREIGN PATENT DOCUMENTS

| | | |
|---|---|---|
| JP | 7 278772 | 10/1995 |

* cited by examiner

*Primary Examiner*—John J Zimmerman
(74) *Attorney, Agent, or Firm*—Oblon, Spivak, McClelland, Maier & Neustadt, P.C.

(57) ABSTRACT

The subject of the invention is a method for the hot-dip coating, in a liquid bath based on zinc containing aluminum, of a running strip of iron-carbon-manganese austenitic steel, in which said strip is subjected to a heat treatment in a furnace in which an atmosphere that is reducing with respect to iron prevails, in order to obtain a strip covered with a thin manganese oxide layer, and then the strip covered with the thin manganese oxide layer is made to run through said bath, the aluminum content in the bath being adjusted to a value at least equal to the content needed for the aluminum to completely reduce the manganese oxide layer, so as to form, on the surface of the strip, a coating comprising an iron-manganese-zinc alloy layer and a zinc surface layer.

28 Claims, 2 Drawing Sheets

HOT-DIP COATING METHOD IN A ZINC BATH FOR STRIPS OF IRON/CARBON/MANGANESE STEEL

The present invention relates to a method for the hot-dip coating, in a liquid bath based on zinc containing aluminum, of a running strip of iron-carbon-manganese austenitic steel.

The steel strip conventionally used in the automotive field, such as for example dual-phase steel strip, is coated with a zinc-based coating in order to protect it from corrosion before being formed or before being delivered. This zinc layer is generally applied continuously, either by electrodeposition in an electrolytic bath containing zinc salts, or by vacuum deposition, or else by hot-dip coating the strip running at high speed through a molten zinc bath.

Before being coated with a zinc layer by being hot-dipped in a zinc bath, the steel strip undergoes recrystallization annealing in a reducing atmosphere so as to give the steel a homogeneous microstructure and to improve its mechanical properties. Under industrial conditions, this recrystallization annealing is carried out in a furnace in which a reducing atmosphere prevails. For this purpose, the strip runs through the furnace, which consists of a chamber completely isolated from the external environment, comprising three zones, namely a heating first zone, a temperature soak second zone and a cooling third zone, in which zones an atmosphere composed of a gas that is reducing with respect to iron prevails. This gas may for example be chosen from hydrogen and nitrogen/hydrogen mixtures and has a dew point between −40° C. and −15° C. Thus, apart from improving the mechanical properties of the steel, the recrystallization annealing of steel strip in a reducing atmosphere allows good bonding of the zinc layer to the steel since the iron oxides present on the surface of the strip are reduced by the reducing gas.

For certain automotive applications that require lightening and greater impact resistance of metal structures, conventional steel grades are starting to be replaced with iron-carbon-manganese austenitic steels that have superior mechanical properties, and especially a particularly advantageous combination of mechanical strength and elongation at break, excellent formability and high tensile strength in the presence of defects or stress concentrations. The applications relate for example to parts that contribute to safety and durability of motor vehicles or else to skin parts.

These steels may also, after recrystallization annealing, be protected from corrosion by a zinc layer. However, the inventors have demonstrated that it is not possible, under standard conditions, to coat an iron-carbon-manganese steel strip running at high speed (greater than 40 m/s) with a zinc layer using a hot-dip coating method in a zinc bath. This is because the oxides of MnO and (Mn,Fe)O type that form during the heat treatment that the strip undergoes before being coated make the surface of the strip nonwetting with respect to liquid zinc.

The object of the present invention is to propose a method for the hot-dip coating, in a liquid zinc-based bath, of a running iron-carbon-manganese steel strip with a zinc-based coating.

For this purpose, the subject of the invention is a method for the hot-dip coating, in a liquid bath based on zinc containing aluminum, said bath having a temperature T2, of a strip of iron-carbon-manganese austenitic steel comprising: $0.30\% \leqq C \leqq 1.05\%$, $16\% \leqq Mn \leqq 26\%$, $Si \leqq 1\%$, and $Al \leqq 0.050\%$, the contents being expressed by weight, said method comprising the steps consisting in:

subjecting said strip to a heat treatment in a furnace in which an atmosphere that is reducing with respect to iron prevails, said heat treatment comprising a heating phase at a heating rate V1, a soak phase at a temperature T1 for a soak time M, followed by a cooling phase at a cooling rate V2, in order to obtain a strip covered on both its sides with a continuous sublayer of an amorphous iron manganese mixed oxide (Fe,Mn)O and with a continuous or discontinuous external layer of crystalline MnO manganese oxide; and then making said strip covered with the oxide layers run through said bath in order to coat the strip with a zinc-based coating, the aluminum content in said bath being adjusted to a value at least equal to the content needed for the aluminum to completely reduce the crystalline MnO manganese oxide layer and at least partially reduce the amorphous (Fe,Mn)O oxide layer so as to form, on the surface of the strip, said coating comprising three iron-manganese-zinc alloy layers and one surface zinc layer.

The subject of the invention is also an iron-carbon-manganese austenitic steel strip coated with a zinc-based coating that can be obtained by this method.

The features and advantages of the present invention will become more clearly apparent over the course of the following description, given by way of nonlimiting example.

The inventors have thus demonstrated that, by creating favorable conditions so that the (Fe,Mn)O mixed oxide/manganese oxide bilayer that forms on the surface of the iron-carbon-manganese steel strip is reduced by the aluminum contained in the liquid zinc-based bath, the surface of the strip becomes wetting with respect to the zinc, thereby allowing it to be coated with a zinc-based coating.

The thickness of this steel strip is typically between 0.2 and 6 mm and may result either from a hot-rolling strip mill or a cold-rolling strip mill.

The iron-carbon-manganese austenitic steel employed according to the invention comprises, in % by weight: $0.30\% \leqq C \leqq 1.05\%$, $16\% \leqq Mn \leqq 26\%$, $Si \leqq 1\%$, $Al \leqq 0.050\%$, $S \leqq 0.030\%$, $P \leqq 0.080\%$, $N \leqq 0.1\%$, and, optionally, one or more elements such as: $Cr \leqq 1\%$, $Mo \leqq 0.40\%$, $Ni \leqq 1\%$, $Cu \leqq 5\%$, $Ti \leqq 0.50\%$, $Nb \leqq 0.50\%$, $V \leqq 0.50\%$, the balance of the composition consisting of iron and inevitable impurities resulting from the smelting.

Carbon plays a very important role in the formation of the microstructure: it increases the stacking fault energy and promotes the stability of the austenitic phase. In combination with a manganese content ranging from 16 to 26% by weight, this stability is obtained for a carbon content of not less than 0.30%. However, for a carbon content of greater than 1.05%, it becomes difficult to prevent the precipitation of carbides which occurs during certain thermal cycles in industrial manufacture, in particular upon cooling after coiling, and which degrades both ductility and toughness.

Preferably, the carbon content is between 0.40 and 0.70% by weight. This is because when the carbon content is between 0.40% and 0.70%, the stability of the austenite is greater and the strength is increased.

Manganese is also an essential element for increasing the strength, increasing the stacking fault energy and stabilizing the austenitic phase. If its content is less than 16%, there is a risk of forming martensitic phases, which very appreciably reduce the deformability. Moreover, when the manganese content is greater than 26%, the ductility at ambient temperature is degraded. In addition, for cost reasons, it is undesirable for the manganese content to be high.

Preferably, the manganese content of the steel according to the invention is between 20 and 25% by weight.

Silicon is an effective element for deoxidizing the steel and for solid-phase hardening. However, above a content of 1%, $Mn_2SiO_4$ and $SiO_2$ layers form on the surface of the steel, which layers exhibit a markedly inferior capability of being reduced by the aluminum contained in the zinc-based bath than the (Fe,Mn)O mixed oxide and MnO manganese oxide layers.

Preferably, the silicon content in the steel is less than 0.5% by weight.

Aluminum is also a particularly effective element for deoxidizing the steel. Like carbon, it increases the stacking fault energy. However, its presence in excessive amount in steels having a high manganese content has a disadvantage: This is because manganese increases the solubility of nitrogen in the liquid iron and if an excessively large amount of aluminum is present in the steel, the nitrogen, which combines with aluminum, precipitates in the form of aluminum nitrides that impede the migration of the grain boundaries during hot transformation and very appreciably increases the risk of cracks appearing. An Al content not exceeding 0.050% makes it possible to prevent precipitation of AlN. Correspondingly, the nitrogen content does not exceed 0.1% so as to prevent this precipitation and the formation of volume defects (blowholes) during solidification.

Furthermore, above 0.050% of aluminum by weight, oxides such as $MnAl_2O_4$ and $MnO.Al_2O_3$ start to form during recrystallization annealing of the steel, these oxides being more difficult to reduce by the aluminum contained in the zinc-based coating bath than (Fe,Mn)O and MnO oxides. This is because these oxides that contain aluminum are much more stable than the (Fe,Mn)O and MnO oxides. Consequently, even if a zinc-based coating were able to be formed on the surface of the steel, this would in any case adhere poorly because of the presence of alumina. Thus, to obtain good adhesion of the zinc-based coating, it is essential for the aluminum content in the steel to be less than 0.050% by weight.

Sulfur and phosphorus are impurities that embrittle the grain boundaries. Their contents must not exceed 0.030% and 0.080%, respectively, so as to maintain sufficient not ductility.

Chromium and nickel may optionally be used to increase the strength of the steel by solid-solution hardening. However, since chromium reduces the stacking fault energy, its content must not exceed 1%. Nickel contributes to obtaining a high elongation at break and in particular increases the toughness. However, it is also desirable, for cost reasons, to limit the nickel content to a maximum content not exceeding 1%. For similar reasons, molybdenum may be added in an amount not exceeding 0.40%.

Likewise, optionally an addition of copper up to a content not exceeding 5% is one means of hardening the steel by the precipitation of metallic copper. However, above this content, copper is responsible for the appearance of surface defects in hot-rolled sheet.

Titanium, niobium and vanadium are also elements that can be optionally used to harden the steel by precipitation by carbonitrides. However, when the Nb or V or Ti content is greater than 0.50%, excessive precipitation of carbonitrides may result in a reduction in toughness, which must be avoided.

After having been cold-rolled, the iron-carbon-manganese austenitic steel strip undergoes a heat treatment so as to recrystallize the steel. The recrystallization annealing makes it possible to give the steel a homogeneous microstructure, to improve its mechanical properties and, in particular, to give it ductility again, so as to allow it to be used by drawing.

This heat treatment is carried out in a furnace in which an atmosphere composed of a gas that is reducing with respect to iron prevails, in order to avoid any excessive oxidation of the surface of the strip, and allows good bonding of the zinc. This gas is chosen from hydrogen and nitrogen/hydrogen mixtures. Preferably, gas mixtures comprising between 20 and 97% nitrogen by volume and between 3 and 80% hydrogen by volume, and more particularly between 85 and 95% nitrogen by volume and between 5 and 15% hydrogen by volume, are chosen. This is because, although hydrogen is an excellent agent for reducing iron, it is preferred to limit its concentration owing to is high cost compared with nitrogen. Having an atmosphere that is reducing with respect to iron in the furnace chamber thus prevents the formation of a thick layer of scale, that is to say one having a thickness substantially greater than 100 nm. In this case of iron-carbon-manganese steels, the scale is an iron oxide layer having a small proportion of manganese. However, not only does this scale layer prevent any adhesion of the zinc to the steel, but also this is a layer that has a tendency to easily crack, making it even more undesirable.

Under industrial conditions, the atmosphere in the furnace is admittedly reducing with respect to iron, but not for elements such as manganese. This is because the gas constituting the atmosphere in the furnace includes traces of moisture and/or of oxygen, which cannot be avoided, but which can be controlled by imposing the dew point of said gas.

Thus, the inventors having observed that, according to the invention, after the recrystallization annealing, the lower the dew point in the furnace, or in other words, the lower the oxygen partial pressure, the thinner the manganese oxide layer formed on the surface of the iron-carbon-manganese steels strip. This observation may seem to be in disagreement with the theory of Wagner, whereby the lower the dew point the higher the density of oxides formed on the surface of a carbon steel strip. This is because when the amount of oxygen decreases at the surface of the carbon steel, the migration of oxidizable elements contained in the steel toward the surface increases, thereby favoring oxidation of the surface. Without wishing to be tied by any particular theory, the inventors believe that, in the case of the invention, the amorphous (Fe,Mn)O oxide layer rapidly becomes continuous. It thus constitutes a barrier for the oxygen of the atmosphere in the furnace, which is no longer in direct contact with the steel. Increasing the oxygen partial pressure in the furnace therefore increases the thickness of the manganese oxide and does not cause internal oxidation, that is to say no additional oxide layer is observed between the surface of the iron-carbon-manganese austenitic steel and the (Fe,Mn)O amorphous oxide layer.

The recrystallization annealing carried out under the conditions of the invention thus makes it possible to form, on both side of the strip, a continuous amorphous (Fe,Mn)O iron manganese mixed oxide sublayer, the thickness of which is preferably between 5 and 10 nm, and a continuous or discontinuous external crystalline MnO manganese oxide layer, the thickness of which is preferably between 5 and 90 nm, advantageously between 5 and 50 nm and more preferably between 10 and 40 nm. The external MnO layer has a granular appearance and the size of the MnO crystals greatly increases when the dew point also increases. This is because their mean diameter varies from about 50 nm for a dew point of −80° C., the MnO layer then being discontinuous, up to 300 nm for a dew point of +10° C., the MnO layer in this case being continuous.

The inventors have demonstrated that, when the aluminum content by weight in the liquid zinc-based is less than 0.18% and when the MnO manganese oxide layer is greater than 100 nm in thickness, the latter is not reduced by the aluminum contained in the bath, and the zinc-based coating is not obtained because of the nonwetting effect of MnO with respect to zinc.

For this purpose, the dew point according to the invention, at least in the temperature soak zone of the furnace, and preferably throughout the chamber of the furnace, is preferably between −80 and 20° C., advantageously between −80 and −40° C. and more preferably between −60 and −40° C.

This is because, under standard industrial conditions, it is possible, under particular conditions, to lower the dew point of a recrystallization annealing furnace to a value below −60° C., but not below −80° C.

Above 20° C., the thickness of the manganese oxide layer becomes too great to be reduced by the aluminum contained in the liquid zinc-based bath under industrial conditions, that is to say over a time of less than 10 seconds.

The −60 to −40° C. range is advantageous as it makes it possible to form an oxide bilayer of relatively small thickness, which will be easily reduced by the aluminum contained in the zinc-based bath.

The heat treatment comprises a heating phase at a heating rate V1, a soak phase at a temperature T1 for a soak time M, followed by a cooling phase at a cooling rate V2.

The heat treatment is preferably carried out at a heating rate V1 of at least 6° C./s, as below this value the soak time M of the strip in the furnace is too long and does not correspond to industrial productivity requirements.

The temperature T1 is preferably between 600 and 900° C. This is because, below 600° C., the steel will not be completely recrystallized and its mechanical properties will be insufficient. Above 900° C., not only does the grain size of the steel increase, which is deleterious to obtaining good mechanical properties, but also the thickness of the MnO manganese oxide layer greatly increases and makes it difficult, if not impossible, for a zinc-based coating to be subsequently deposited, since the aluminum contained in the bath will not have completely reduced the MnO. The lower the temperature T1, the smaller the amount of MnO formed, and the easier it will be for the aluminum to reduce it, which is why T1 is preferably between 600 and 820° C., advantageously 750° C. or below, and preferably between 650 and 750° C.

The soak time M is preferably between 20 s and 60 s and advantageously between 20 and 40 s. The recrystallization annealing is generally carried out by a heating device based on radiant tubes.

Preferably, the strip is cooled down to a strip immersion temperature T3 between (T2−10° C.) and (T2+30° C.), T2 being defined as the temperature of the liquid zinc-based bath. Cooling this strip to a temperature T3 close to the temperature T2 of the bath avoids having to cool or reheat the liquid zinc near the strip running through the bath. This makes it possible to form on the strip a zinc-based coating having a homogeneous structure over the entire length of the strip.

The strip is preferably cooled at a cooling rate V2 of 3° C./s or higher, advantageously greater than 10° C./s, so as to prevent grain coarsening and to obtain a steel strip having good mechanical properties. Thus, the strip is generally cooled by injecting a stream of air onto both its sides.

When, after having undergone the recrystallization annealing, the iron-carbon-manganese austenitic steel strip is covered on both its sides with the oxide bilayer, it is run through the liquid aluminum-containing zinc-based bath.

The aluminum contained in the zinc bath contributes not only to the at least partial reduction of the oxide bilayer but also to obtaining a coating that has a homogeneous surface appearance.

A homogeneous surface appearance is characterized by a uniform thickness, whereas a heterogeneous appearance is characterized by large thickness heterogeneities. Unlike what occurs in the case of carbon steels, an interfacial layer of the $Fe_2Al_5$ and/or $FeAl_3$ type does not form on the surface of the iron-carbon-manganese steel, or, if this does form, it is immediately destroyed by the formation of (Fe,Mn)Zn phases. However, dross of the $Fe_2Al_5$ and/or $FeAl_3$ type is found in the bath.

The aluminum content in the bath is adjusted to a value at least equal to the content needed for the aluminum to completely reduce the crystalline MnO manganese oxide layer and at least partly the amorphous (Fe,Mn)O oxide layer.

For this purpose, the aluminum content by weight in the bath is between 0.15 and 5%. Below 0.15%, the aluminum content will be insufficient to completely reduce the MnO manganese oxide layer and at least partially the (Fe,Mn)O layer, and the surface of the steel strip will not have sufficient wettability with respect to the zinc. Above 5% aluminum in the bath, a coating of the type different from the obtained by the invention will be formed on the surface of the steel strip. This coating will comprise an increasing proportion of aluminum as the aluminum content in the bath increases.

Apart from aluminum, the zinc-based bath may also contain iron, preferably with a content such that it is supersaturated with respect to $Fe_2Al_5$ and/or $FeAl_3$.

To keep the bath in the liquid state, it is preferably heated to a temperature T2 of 430° C. or higher, but to avoid any excessive evaporation of zinc, T2 does not exceed 480° C.

Preferably, the strip is in contact with the bath for a contact time C between 2 and 10 seconds and more preferably between 3 and 5 seconds.

Below 2 seconds, the aluminum does not have sufficient time to completely reduce the MnO manganese oxide layer and at least partly the (Fe,Mn)O mixed oxide layer, and thus make the surface of the steel wetting with respect to zinc. Above 10 seconds, the oxide bilayer will admittedly be completely reduced, however there is a risk of the line speed being too low from an industrial standpoint, and the coating too alloyed and then difficult to adjust in terms of thickness.

These conditions allow the strip to be coated on both its sides with a zinc-based coating comprising, in order starting from the steel/coating interface, a layer of iron-manganese-zinc alloy composed of two phases, namely a cubic phase Γ and a face-centered cubic phase Γ 1, a layer of iron-manganese-zinc alloy δ 1 of hexagonal structure, a layer of iron-manganese-zinc alloy ζ of monoclinic structure, and a zinc surface layer.

The inventors have thus confirmed that, according to the invention, and contrary to what appears in the case of the coating of a carbon steel strip in an aluminum-containing zinc-based bath, an $Fe_2Al_5$ layer does not form at the steel/coating interface. According to the invention, the aluminum in the bath reduces the oxide bilayer. However, the MnO layer is more easily reducible by the aluminum of the bath than the silicon-based oxide layers. This results in a local aluminum depletion, which leads to the formation of a coating comprising FeZn phases instead of the expected $Fe_2Al_5$(Zn) coating, which forms in the case of carbon steels.

To improve weldability of the strip coated with the zinc-based coating comprising three iron-manganese-zinc alloy layers and one zinc surface layer according to the invention, it is subjected to an alloying heat treatment so as to completely alloy said coating. Thus, what is obtained is a strip coated on both its sides with a zinc-based coating comprising, in order starting from the steel coating interface, a layer of iron-manganese-zinc alloy composed of two phases, namely a cubic phase Γ and a face-centered cubic phase Γ 1, a layer of iron-manganese-zinc alloy δ 1 of hexagonal structure, and optionally a layer of iron-manganese-zinc alloy ζ of monoclinic structure.

Furthermore, the inventors have demonstrated that these (Fe,Mn)Zn compounds are favorable to the adhesion of paint.

The alloying heat treatment is preferably carried out directly after the steel leaves the zinc bath, at a temperature between 490 and 540° C. for a time between 2 and 10 seconds.

BRIEF DESCRIPTION OF THE DRAWINGS

The invention will now be illustrated by examples given by way of nonlimiting indication and with reference to the appended figures in which.

Figure 1:
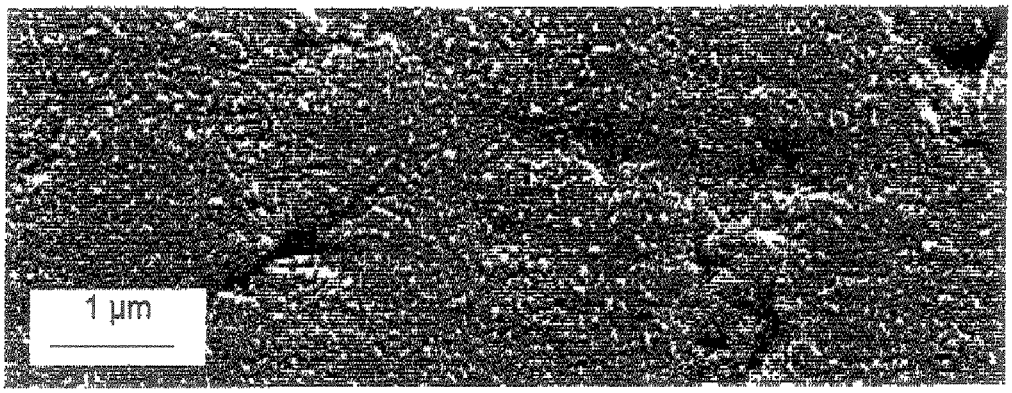
FIGS. 1, 2 and 3 are photographs of the surface of an iron-carbon-manganese austenitic steel strip that has undergone annealing with a dew point of −80° C., −45° C. and +10° C., respectively, under the conditions described below.
Figure 2:
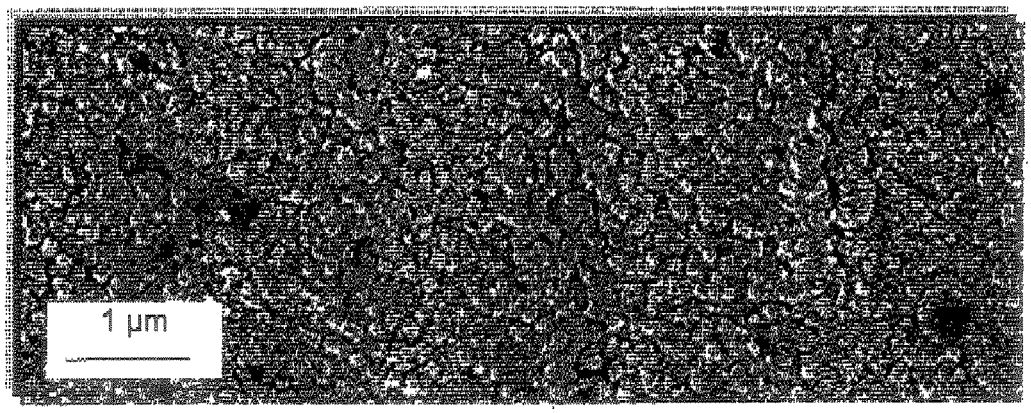
Figure 3:
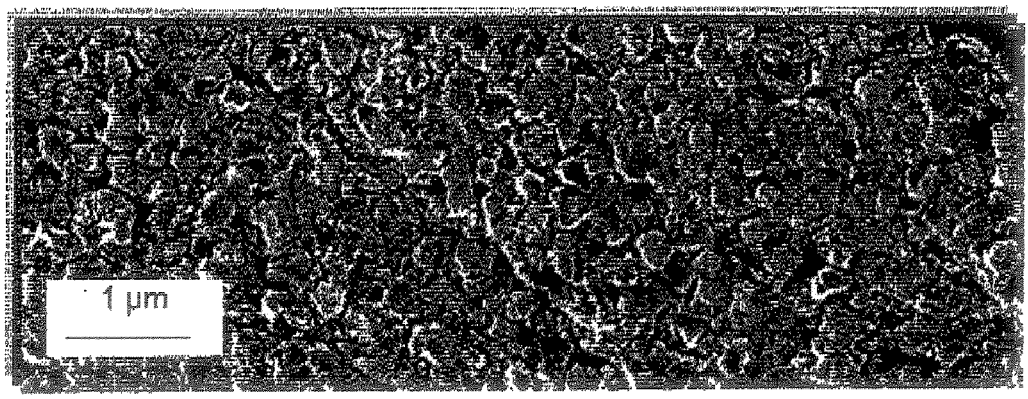
Figure 4:
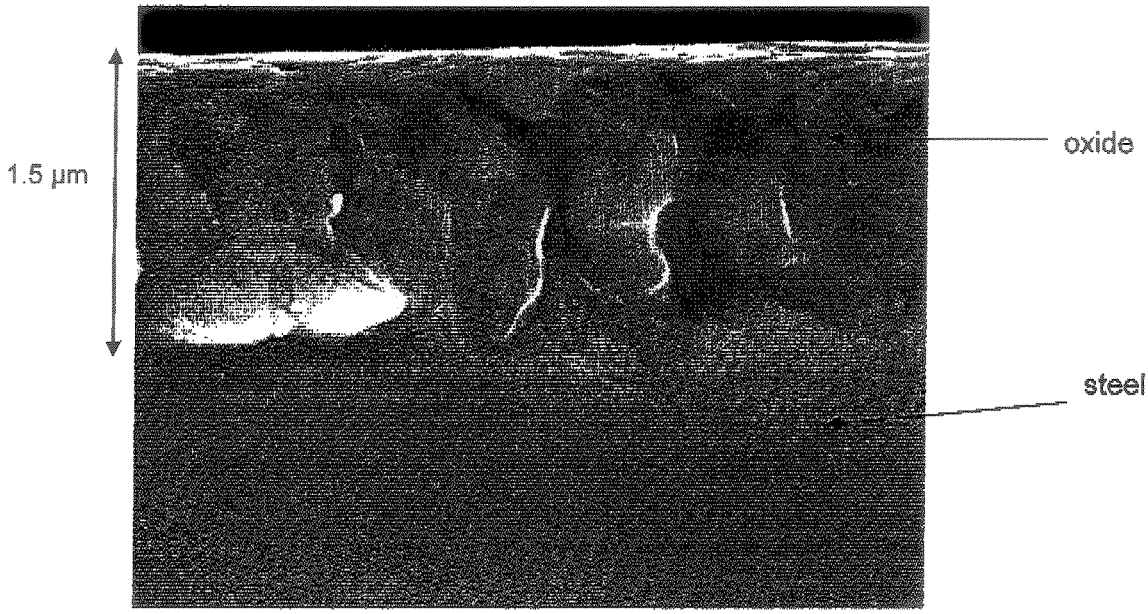
FIG. 4 is an SEM micrograph showing a cross section through the oxide bilayer formed on an iron-carbon-manganese austenitic steel after recrystallization annealing with a dew point of +10° C. under the conditions described below.
Figure 5:
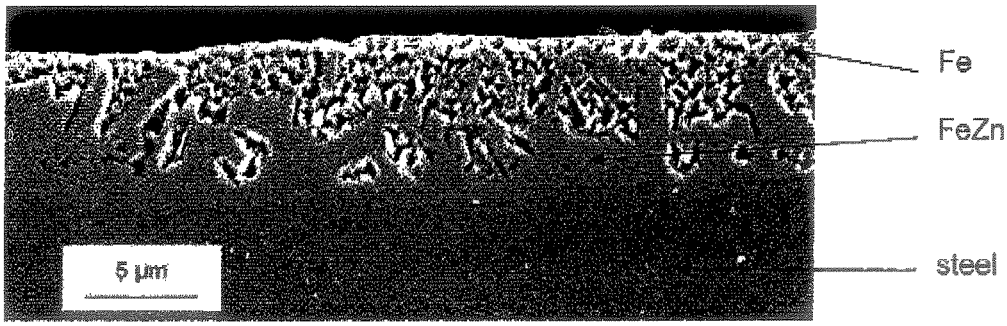
FIG. 5 is an SEM micrograph showing a cross section through the zinc-based coating formed after immersion in a zinc bath containing 0.18% aluminum by weight, on an iron-carbon-manganese austenitic steel annealed, with a −80° C. dew point, under the conditions described below.

1) Influence of the Dew Point on Coatability

Tests were carried out using specimens cut from a strip of iron-carbon-manganese austenitic steel which, after hot rolling and cold rolling, had a thickness of 0.7 mm. The chemical composition of this steel is given in Table 1, the contents being expressed in % by weight.

TABLE 1

| Mn | C | Si | Al | S | P | Mo | Cr |
|---|---|---|---|---|---|---|---|
| 20.77 | 0.57 | 0.009 | traces | 0.008 | 0.001 | 0.001 | 0.049 |

The specimens were subjected to recrystallization annealing in an infrared furnace, the dew point (DP) of which was varied from −80° C. to +10° C. under the following conditions:

gas atmosphere: nitrogen+15% hydrogen by volume;

heating rate V1: 6° C./s heating temperature T1: 810° C.;

soak time M: 42 s;

cooling rate V2: 3° C./s; and immersion temperature T3: 480° C.

Under these conditions, the steel was completely recrystallized and Table 2 gives the characteristics of the oxide bilayer comprising an (Fe,Mn)O amorphous continuous lower layer and an MnO upper layer, formed on specimens after the annealing, as a function of the dew point.

TABLE 2

| | −80° C. DP | −45° C. DP | +10° C. DP |
|---|---|---|---|
| Color of the surface of the strip | yellow | green | blue |
| Mean diameter of the MnO crystals (nm) | 50 (discontinuous layer) | 100 (continuous layer) | 300 (continuous layer) |
| Thickness of the bilayer (nm) | 10 | 110 | 1500 |

After having been recrystallized, the specimens were cooled down to a temperature T3 of 480° C. and immersed in a zinc bath comprising, by weight, 0.18% aluminum and 0.02% iron, the temperature T2 of which was 460° C. The specimens remained in contact with the bath for a contact time C of 3 seconds. After immersion, the specimens were examined to check whether a zinc-based coating was present on the surface of the specimen. Table 3 indicates the results obtained as a function of the dew point.

TABLE 3

| | −80° C. DP | −45° C. DP | +10° C. DP |
|---|---|---|---|
| Presence of the zinc-based coating | yes | no | no |

The inventors have demonstrated that if the oxide bilayer formed on the iron-carbon-manganese austenitic steels strip after recrystallization annealing was greater than 110 nm, the presence in the bath of 0.18% by weight of aluminum was insufficient to reduce the oxide bilayer and to give the strip sufficient wettability or zinc with respect to the steel in order to form a zinc-based coating.

2) Influence of the Aluminum Content in the Steel

Tests were carried out using specimens cut form an iron-carbon-manganese austenitic steel strip which, after hot rolling and cold rolling, had a thickness of 0.7 mm. The chemical compositions of the steels used are given in Table 4, the contents being expressed in % by weight.

TABLE 4

| | Mn | C | Si | Al |
|---|---|---|---|---|
| Steel A | 25.10 | 0.50 | 0.009 | 1.27 |
| *Steel B | 24.75 | 0.41 | 0.009 | traces |

*according to the invention

The specimens were subjected to recrystallization annealing in an infrared furnace, the dew point (DP) of which was −80° C. under the following conditions:

gas atmosphere: nitrogen+15% hydrogen by volume;

heating rate V1: 6° C./s;

heating temperature T1: 810° C.;

soak time M: 42 s;

cooling rate V2: 3° C./s; and immersion temperature T3: 480° C.

Under these conditions, the steel is completely recrystallized and Table 5 gives the structures of the various oxide films that were formed on the surface of the steel after the annealing as a function of the composition of the steel.

TABLE 5

| Oxide films | Steel A | *Steel B |
|---|---|---|
| Sublayer | $MnAl_2O_4$ | (Fe,Mn)O |
| Upper layer | $MnO \bullet Al_2O_3$ | MnO |

*according to the invention

After having been recrystallized, the specimens were cooled to a temperature T3 of 480° C. and immersed in a zinc bath containing 0.18% aluminum and 0.02% iron, the temperature T2 of which was 460° C. The specimens remained in contact with the bath for a contact time C of 3 seconds. After immersion, the specimens were coated with a zinc-based coating.

To characterize the adhesion of this zinc-based coating formed on the specimens of steel A and steel B, an adhesive tape was applied to the coated steel and then torn off. Table 6 gives the results after tearing off the adhesive strip in this adhesion test. The adhesion was assessed by a gray level rating on the adhesive tape, starting from 0, for which the tape remains clean after tearing, up to the level 3, in which the gray level is the most intense.

TABLE 6

| | |
|---|---|
| Steel A | Poor adhesion, gray level: 3 |
| *Steel B | Good adhesion, gray level: 0, no trace of zinc-based coating on the adhesive tape |

*according to the invention

The invention claimed is:

1. A method for hot-dip coating a strip of iron-carbon-manganese austenitic steel comprising:

0.30% ≦C ≦1.05%, 16% ≦Mn ≦26%, Si ≦1%, and Al ≦0.050%, the contents expressed by weight, in a liquid zinc bath comprising aluminum and having a temperature T2, said method comprising:

heat treating said strip in a furnace which has an atmosphere that reduces iron, said heat treating comprising heating at a heating rate V1, soaking at a temperature T1 for a soak time M, followed by cooling at a cooling rate V2, to obtain a strip covered on both its sides with a continuous sublayer of an amorphous iron manganese mixed oxide (Fe,Mn)O and with a continuous or discontinuous external layer of crystalline MnO manganese oxide; and running said strip covered with oxide layers through said liquid zinc bath to coat the strip with a zinc-based coating, wherein the aluminum content in said bath is adjusted to a value at least equal to the content needed for the aluminum to completely reduce the crystalline MnO manganese oxide layer and at least partially reduce the amorphous (Fe,Mn)O oxide layer to form, on the surface of the strip, said coating comprising three iron-manganese-zinc alloy layers and one surface zinc layer, to form a coated steel strip.

2. The method as claimed in claim 1, wherein said atmosphere comprises a gas selected from the group consisting of hydrogen and a nitrogen-hydrogen mixture

3. The method as claimed in claim 2, wherein said gas comprises between 20 and 97% nitrogen by volume and between 3 and 80% hydrogen by volume.

4. The method as claimed in claim 3, wherein said gas comprises between 85 and 95% nitrogen by volume and between 5 and 15% hydrogen by volume.

5. The method as claimed in claim 1, wherein a gas of said atmosphere has a dew point between −80 and 20° C.

6. The method as claimed in claim 5, wherein said gas has a dew point between −80 and −40° C.

7. The method as claimed in claim 6, wherein said gas has a dew point between −60 and −40C.

8. The method as claimed in claim 1, wherein said heating rate V1 is 6° C./s or higher, said temperature T1 between 600 and 900° C.

said soak time M is between 20 s and 60 s, and said cooling rate V2 is 3° C./s or higher thereby cooling down to a strip immersion temperature T3 between (T2 −10° C.) and (T2 +30° C.), wherein T3 is the strip immersion temperature and T2 is the temperature of said liquid zing-based bath.

9. The method as claimed in claim 8, wherein the temperature T1 is between 650 and 820° C.

10. The method as claimed in claim 9, wherein the temperature T1 does not exceed 750° C.

11. The method as claimed in claim 1, wherein the soak time M is between 20 and 40 s.

12. The method as claimed in claim 1, wherein said heat treating is carried out in a reducing atmosphere to form an amorphous (Fe,Mn)O mixed oxide layer with a thickness of between 5 and 10 nm, together with a crystalline MnO manganese oxide layer having a thickness between 5 and 90 nm, before the MnO layer is reduced by the aluminum of the bath.

13. The method as claimed in claim 1, wherein the crystalline MnO manganese oxide layer has a thickness between 5 and 50 nm.

14. The method as claimed in claim 1, wherein the crystalline MnO manganese oxide layer has a thickness between 10 and 40 nm.

15. The method as claimed in claim 1, wherein said liquid zinc bath comprises between 0.15 and 5% aluminum by weight.

16. The method as claimed in claim 1, wherein said temperature T2 is between 430 and 480° C.

17. The method as claimed in claim 1, wherein the strip is in contact with said liquid zinc bath for a contact time C between 2 and 10 s.

18. The method as claimed in claim 17, wherein the contact time C is between 3 and 5 s.

19. The method as claimed in claim 1, wherein the carbon content of the steel is between 0.40 and 0.70% by weight.

20. The method as claimed in claim 1, wherein the manganese content of the steel is between 20 and 25% by weight.

21. The method as claimed in claim 1, wherein after the austenitic steel strip has been coated with the coating comprising three iron-manganese-zinc alloy layers and surface zinc layer, said coated strip is subjected to a heat treatment so as to completely alloy said coating.

22. The iron-carbon-manganese austenitic steel strip obtained by the method as claimed in claim 21, the chemical composition of which comprises, the contents expressed by weight:

$0.30\% \leqq C \leqq 1.05\%$ $16\% \leqq Mn \leqq 26\%$ $Si \leqq 1\%$ $Al \leqq 0.050\%$ $S \leqq 0.030\%$ $P \leqq 0.080\%$ $N \leqq 0.1\%$, and, optionally, at least one selected from the group consisting of $Cr \leqq 1\%$ $Mo \leqq 0.40\%$ $Ni \leqq 1\%$ $Cu \leqq 5\%$ $Ti \leqq 0.50\%$ $Nb \leqq 0.50\%$ and $V \leqq 0.50\%$, the balance of the composition consisting of iron and inevitable impurities, wherein said strip is coated on least one sides with a zinc-based coating comprising, in order starting from the steel/coating interface, a layer of iron-manganese-zinc alloy having a cubic phase Γ and a face-centered cubic phase Γ 1, and a layer of iron-manganese-zinc alloy δ1 of hexagonal structure.

23. The steel strip as claimed in claim 22, wherein said strip has a Surface layer of iron-manganese-zinc alloy ζ of monoclinic structure.

24. An iron-carbon-manganese austenitic steel strip obtained by the method as claimed in claim 1, the chemical composition of which comprises, the contents expressed by weight:

$0.30\% \leqq C \leqq 1.05\%$ $16\% \leqq Mn \leqq 26\%$ $Si \leqq 1\%$ $Al \leqq 0.050\%$ $S \leqq 0.030\%$ $P \leqq 0.080\%$ $N \leqq 0.1\%$, and, optionally, at least one selected from the group consisting of $Cr \leqq 1\%$ $Mo \leqq 0.40\%$ $Ni \leqq 1\%$ $Cu \leqq 5\%$ $Ti \leqq 0.50\%$ $Nb \leqq 0.50\%$ and $V \leqq 0.50\%$, the balance of the composition consisting of iron and inevitable impurities, wherein said strip is coated on both sides with a zinc-based coating comprising, in order starting from the steel/coating interface, a layer of iron-manganese-zinc alloy having a cubic phase Γ and a face-centered cubic phase Γ1, a layer of iron-manganese-zinc alloy δ1 of hexagonal structure, a layer of iron-manganese-zinc alloy ζ of monoclinic structure, and a zinc surface layer.

25. The steel strip as claimed in claim 24, wherein the silicon content is less then 0.5% by weight.

26. The steel strip as claimed in claim 24, wherein the carbon content is between 0.40 and 0.70% by weight.

27. The steel strip as claimed in claim 24, wherein the manganese content is between 20 and 25% by weight.

28. The method as claimed in claim 1, further comprising heat treating said coated strip to alloy said coating.

* * * * *